US006024118A

United States Patent [19]

Ikari et al.

[11] Patent Number: 6,024,118

[45] Date of Patent: Feb. 15, 2000

[54] ICE DISPENSER

[75] Inventors: Hideyuki Ikari; Hiroshi Ueno, both of Aichi-ken, Japan

[73] Assignee: Hoshizaki Denki Kabushiki Kaisha, Toyoake, Japan

[21] Appl. No.: 09/249,901

[22] Filed: Feb. 17, 1999

[30] Foreign Application Priority Data

Feb. 17, 1998 [JP] Japan ..... 10-35072

[51] Int. Cl.[7] ..... F16L 7/00

[52] U.S. Cl. ..... 137/375; 251/144

[58] Field of Search ..... 137/375; 251/144

[56] References Cited

U.S. PATENT DOCUMENTS 4,462,437 7/1984 Prada ..... 251/54

*Primary Examiner*—A. Michael Chambers
*Attorney, Agent, or Firm*—Wenderoth, Lind & Ponack, L.L.P.

[57] ABSTRACT

An ice dispenser includes a metal bracket fixed to the outer wall surface of an ice stocker and supports a shutter mechanism. A spacer made of a thermally insulating material is intervened between the bracket and the shutter mechanism. This will prevent cold inside the ice stocker from being conducted into the shutter mechanism to obviate the deposition of dew-condensation water on the shutter mechanism.

3 Claims, 6 Drawing Sheets

ICE DISPENSER

BACKGROUND OF THE INVENTION

1. Field of the Invention

The present invention generally relates to an ice dispenser, and more specifically to such an ice dispenser in which ice blocks stored in an ice stocker can be dispensed from an ice dispensing outlet formed at the front of a dispenser body.

2. Description of the Related Art

An example of conventional ice dispensers is illustrated in FIGS. 4 through 6. In these figures, an ice dispenser 1 contains within a body 2 thereof an auger ice maker mechanism 3 serving as an ice maker portion, and an ice stocker 4 serving as an ice reservoir portion.

The ice stocker 4 is disposed on the top of the auger ice maker mechanism 3. The ice stocker 4 is made of metal such as stainless steel, and a thermally insulating layer 5 made of a thermally insulating material is formed over the outer surface of the ice stocker 4. Further, an ice discharge opening 9 is formed at the lower portion in the outer wall surface of the ice stocker 4 which is a cylindrically shaped member. The ice discharge opening 9 is located at the front of the body 2. A bracket 6 as shown in FIG. 5 is arranged above the ice discharge opening 9.

The bracket 6 is fixed to the outer wall surface of the ice stocker 4 by welding, and a shutter mechanism 7 for opening/closing the ice discharge opening 9 is secured to the bracket 6 by a plurality of screws 8, as shown in FIG. 6. The shutter mechanism 7 comprises an opening/closing member 10 for opening/closing the ice discharge opening 9, a plunger 12 connected to the opening/closing member 10 through a link member 11, and a solenoid 13 for vertically driving the plunger 12 in an advancing and retracting manner. When the solenoid 13 pulls the plunger 12 upward by means of the electromagnetic force, as shown in double-dotted chain lines in FIG. 6, the opening/closing member 10 may rotate about a shaft 14 in the counterclockwise direction as shown in FIG. 6. As a result, the ice discharge opening 9 is opened.

As shown in FIG. 4, an ice dispensing outlet 15 is formed at the center of the front of the body 2. When the ice discharge opening 9 is opened by the shutter mechanism 7, the ice stored in the ice stocker 4 is discharged from the ice discharge opening 9, and then dispensed from the ice dispensing outlet 15 through a chute (not shown). A switching operation piece 16 is arranged beneath the ice dispensing outlet 15, and is activated by pushing with a glass or the like. If the switching operation piece 16 is forcibly pushed toward the body 2, the solenoid 13 in the shutter mechanism 7 is excited so that the opening/closing member 10 allows the ice discharge opening 9 to be opened, and the ice is discharged therefrom.

However, the foregoing conventional ice dispenser may permit the cold inside the ice stocker 4 to be conducted to the shutter mechanism 7 through the bracket 6, causing dew-condensation water to be deposited on the shutter mechanism 7. Thus, there was a fear that such dew-condensation water would flow into the solenoid 13 to result in malfunction of the shutter mechanism 7.

SUMMARY OF THE INVENTION

The present invention has been made to solve the above-described problem, and an object of the present invention is to provide an ice dispenser capable of preventing malfunction of a shutter mechanism resulting from dew-condensation water, and dispensing the ice stored in an ice stocker without fail.

In order to achieve the above-stated object, the ice dispenser according to the present invention comprises: an ice stocker made of metal having an ice discharge opening; a bracket made of metal mounted on the outer wall surface of the ice stocker; a shutter mechanism mounted to the bracket for opening/closing the ice discharge opening; and a spacer made of a thermally insulating material being intervened between the shutter mechanism and the bracket. Preferably, the spacer is formed integrally with a thermally insulating layer covering the outer surface of the ice stocker. Preferably, the shutter mechanism and the spacer are secured to the bracket by common screws. Preferably, the spacer includes a protrusion for positioning the shutter mechanism to a predetermined position.

DESCRIPTION OF THE PREFERRED EMBODIMENTS

Embodiment 1

Figure 1:
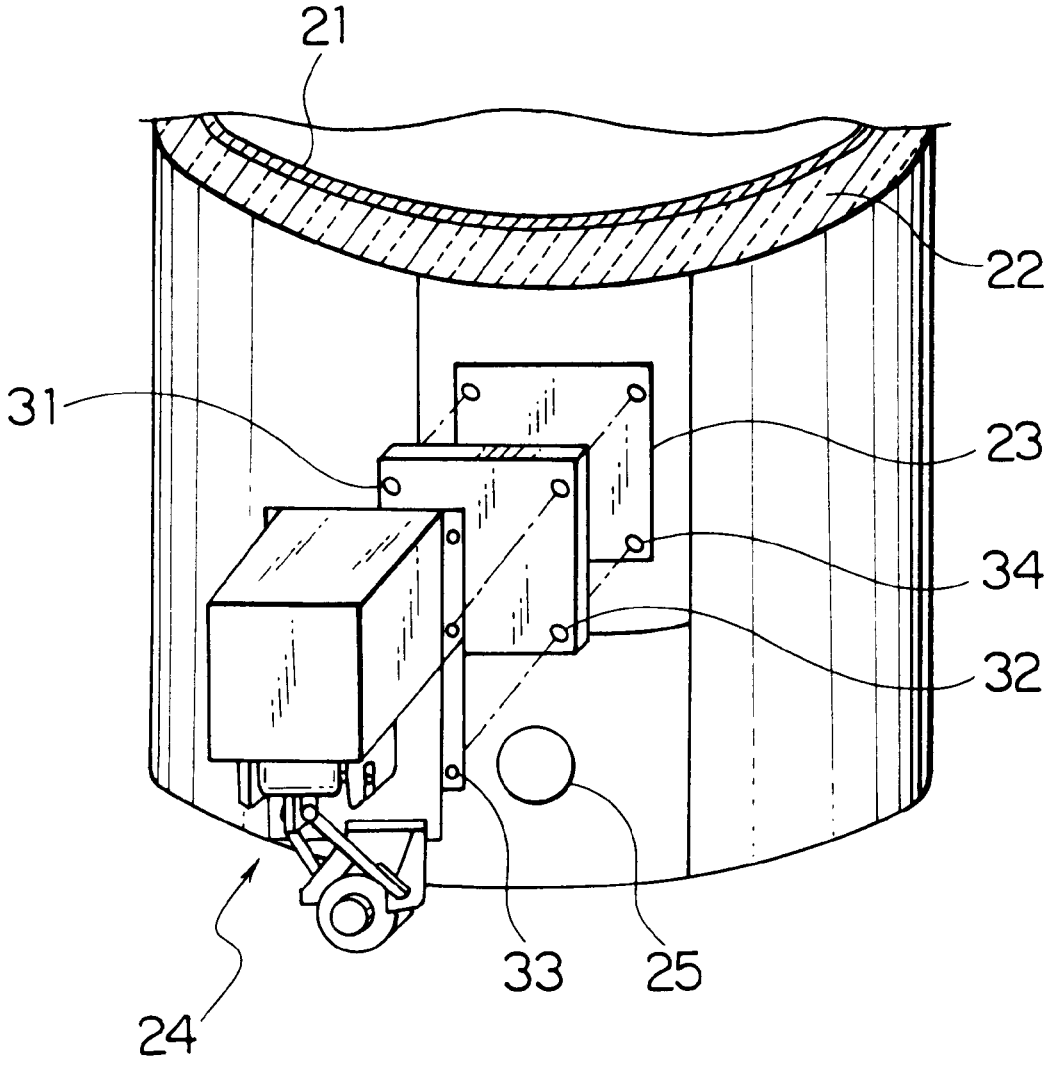
FIG. 1 is a perspective view showing a main portion of an ice dispenser in accordance with a first embodiment of the present invention.

Hereinafter, some preferred embodiments of the present invention will be described with reference to the accompanying drawings. FIG. 1 is a perspective view showing an ice stocker and a shutter mechanism of an ice dispenser in accordance with a first embodiment of the present invention. An ice stocker 21 is a cylindrical member made of metal, and stores the ice which has been produced in an ice maker portion therewithin. A thermally insulating layer 22 made of a thermally insulating material covers the periphery of the ice stocker 21 so that outer heat is transmitted only with difficulty to the interior of the ice stocker 21.

Figure 2:
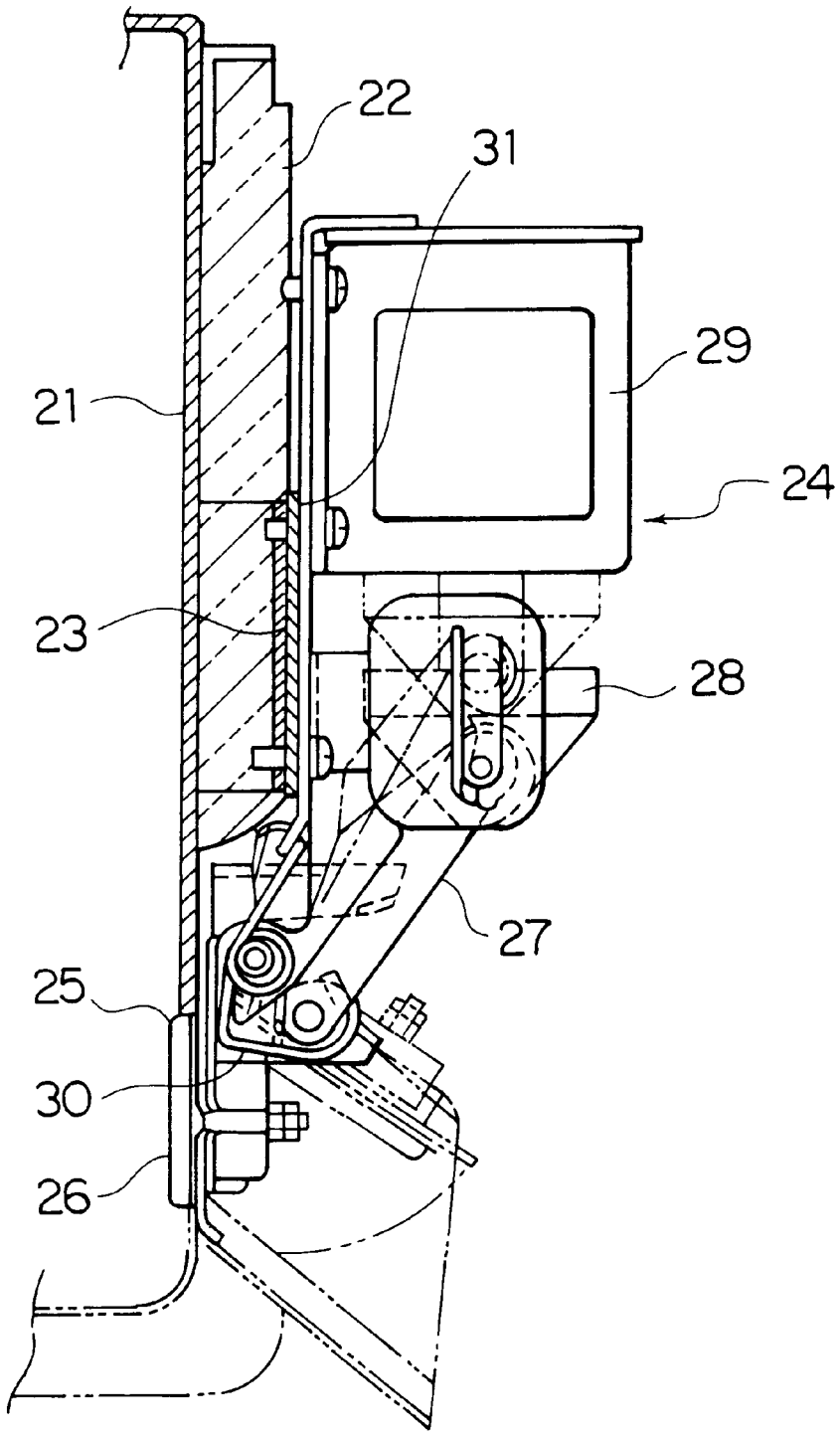
FIG. 2 is a sectional view showing a vicinity of a shutter mechanism shown in FIG. 1.

A bracket 23 made of metal is mounted onto the outer wall surface of the ice stocker 21 by welding, and a shutter mechanism 24 is secured to the bracket 23 by a plurality of screws. The shutter mechanism 24 is designed to open and close an ice discharge opening 25 formed at the front of the ice stocker 21. As shown in FIG. 2, the shutter mechanism 24 comprises an opening/closing member 26 for opening/closing the ice discharge opening 25, a plunger 28 connected to the opening/closing member 26 through a link member 27, and a solenoid 29 for driving the plunger 28 upward and downward. A resilient force in the closing direction due to a torsion coil spring 30 is applied to the opening/closing member 26. The ice discharge opening 25 is normally closed by the opening/closing member 26. Once dispensing of the produced ice is desired, the solenoid 29 is excited, and the resulting electromagnetic force allows the plunger 28 to be pulled upward. Then, the opening/closing member 26 rotates counterclockwise as shown in FIG. 2 through the link member 27 so that the ice discharge opening 25 is opened.

A mounting mode of the shutter mechanism 24 will now be described with reference to FIGS. 1 and 2. The outer surface of the thermally insulating layer 22 is made planar at the upper portion of the ice discharge opening 25, where the metal bracket 23 is exposed. The shutter mechanism 24 is secured to the bracket 23 by a plurality of screws through a spacer 31 made of a thermally insulating material such as a resin. The spacer 31 and the shutter mechanism 24 are formed with screw insertion through-holes 32 and 33, respectively, and the bracket 23 is formed with screw holes 34. The shutter mechanism 24 is screwed to the bracket 23 through the spacer 31.

In the thus arranged ice dispenser of the present embodiment, the spacer 31 made of a thermally insulating material is intervened between the bracket 23 and the shutter mechanism 24. For this reason, even if the ice stocker 21 and the bracket 23 supporting the shutter mechanism 24 were both made of metal, cold from the ice stocker 21 will not be conducted to the shutter mechanism 24 through the bracket 23. Therefore, no dew-condensation will be generated on the shutter mechanism 24, and no dew-condensation water flows into the solenoid 29 so that malfunction of the shutter mechanism 24 can be avoided. Accordingly, the ice stored in the ice stocker 21 can be discharged from the ice discharge opening 25 without fail.

Embodiment 2

Figure 3:
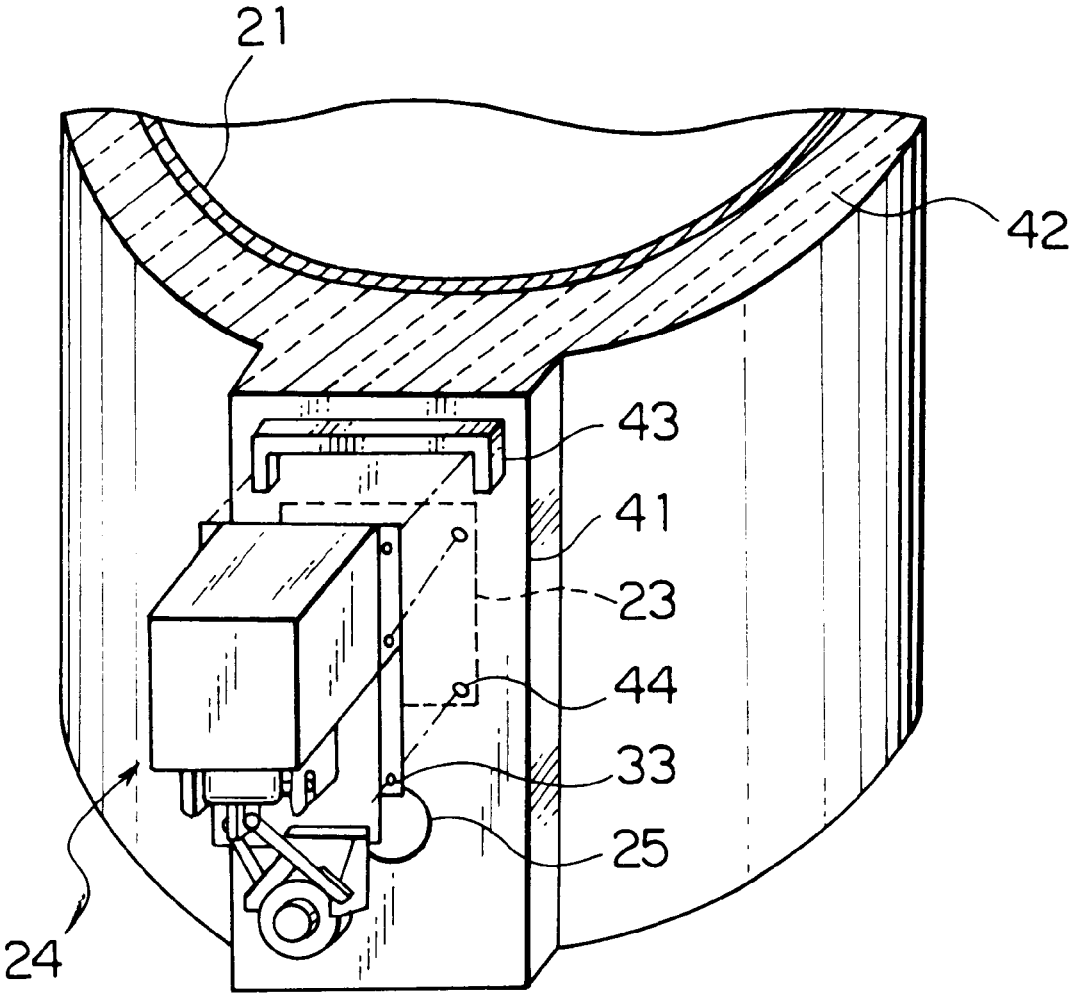
FIG. 3 is a perspective view showing a main portion of an ice dispenser in accordance with a second embodiment of the present invention.
Figure 4:
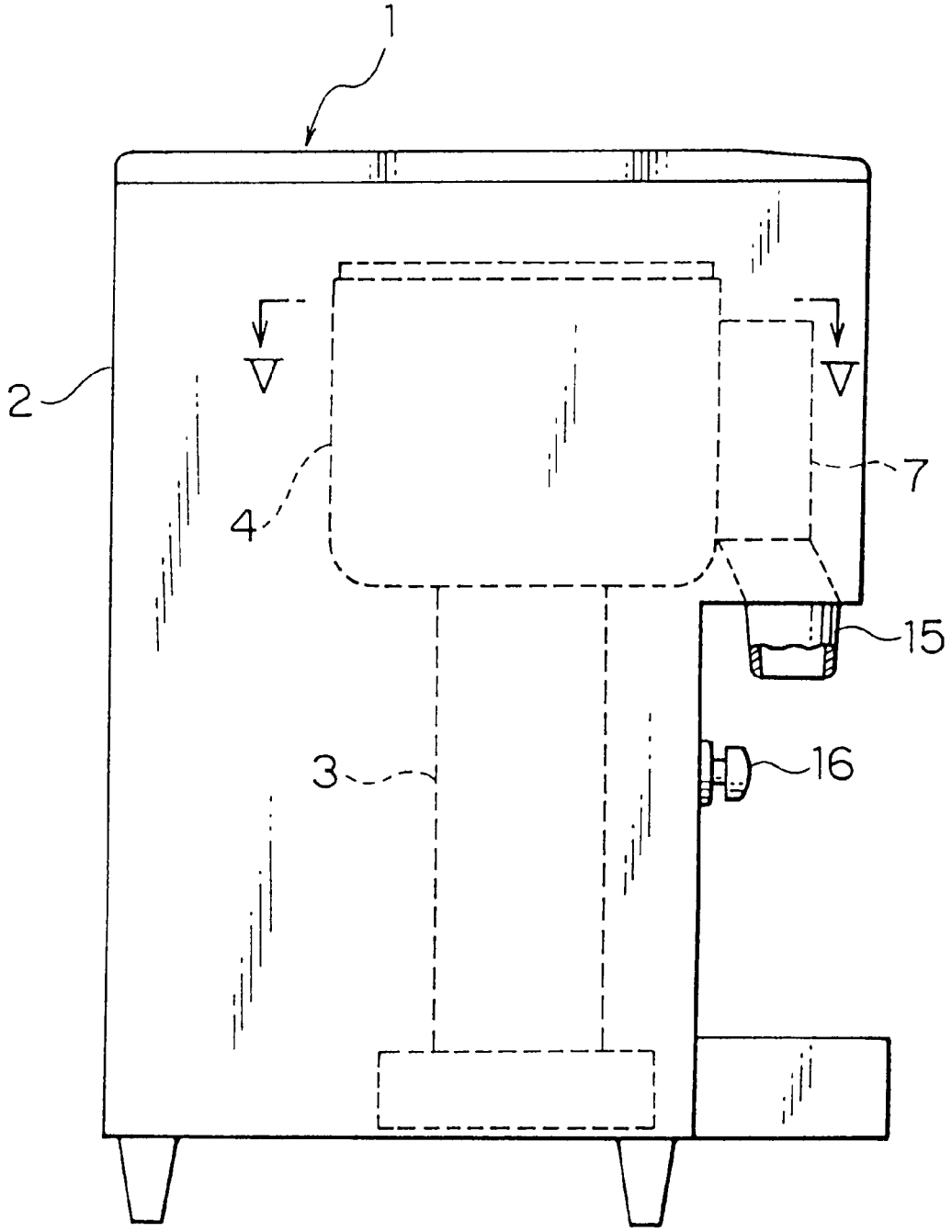
FIG. 4 PRIOR ART
FIG. 4 is a side view showing a conventional ice dispenser.
Figure 5:
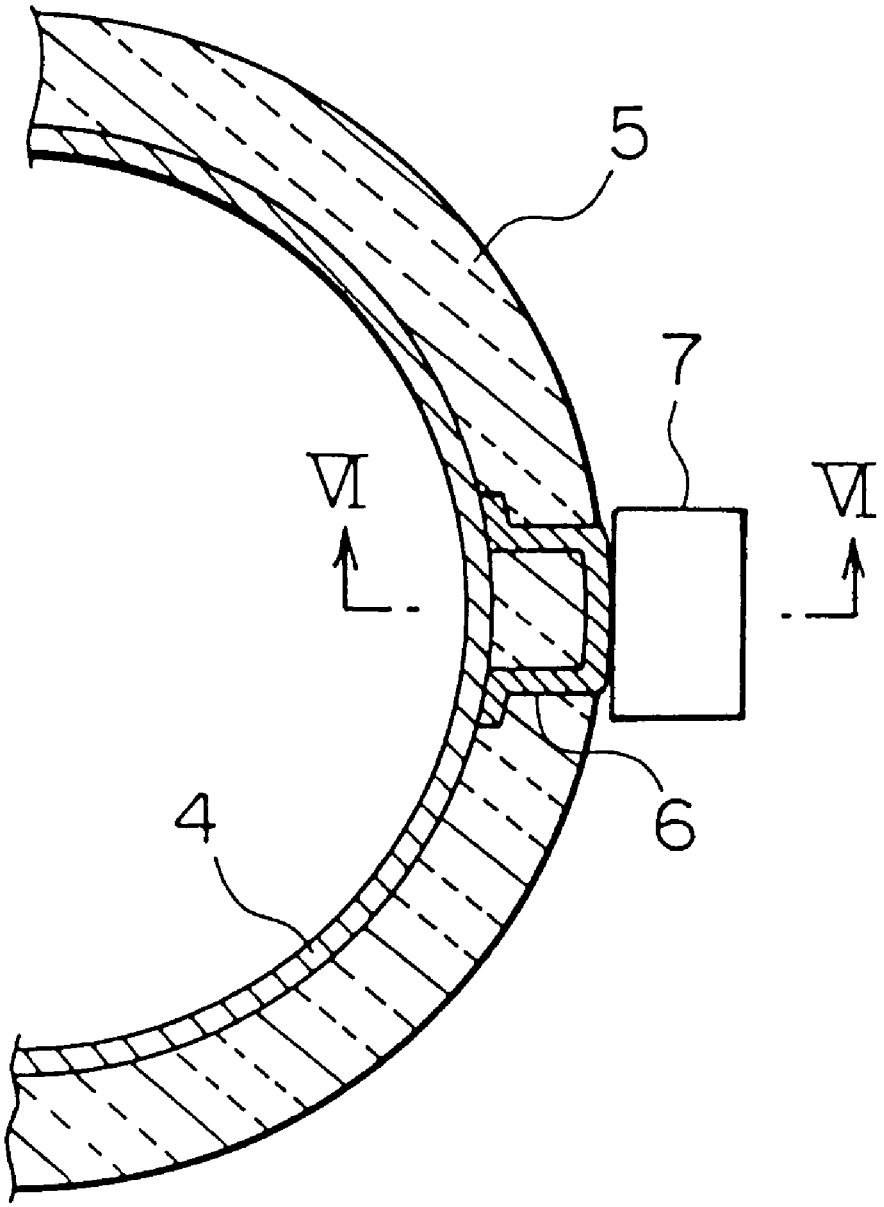
FIG. 5 PRIOR ART
FIG. 5 is a sectional view taken along the line V—V of FIG. 4.
Figure 6:
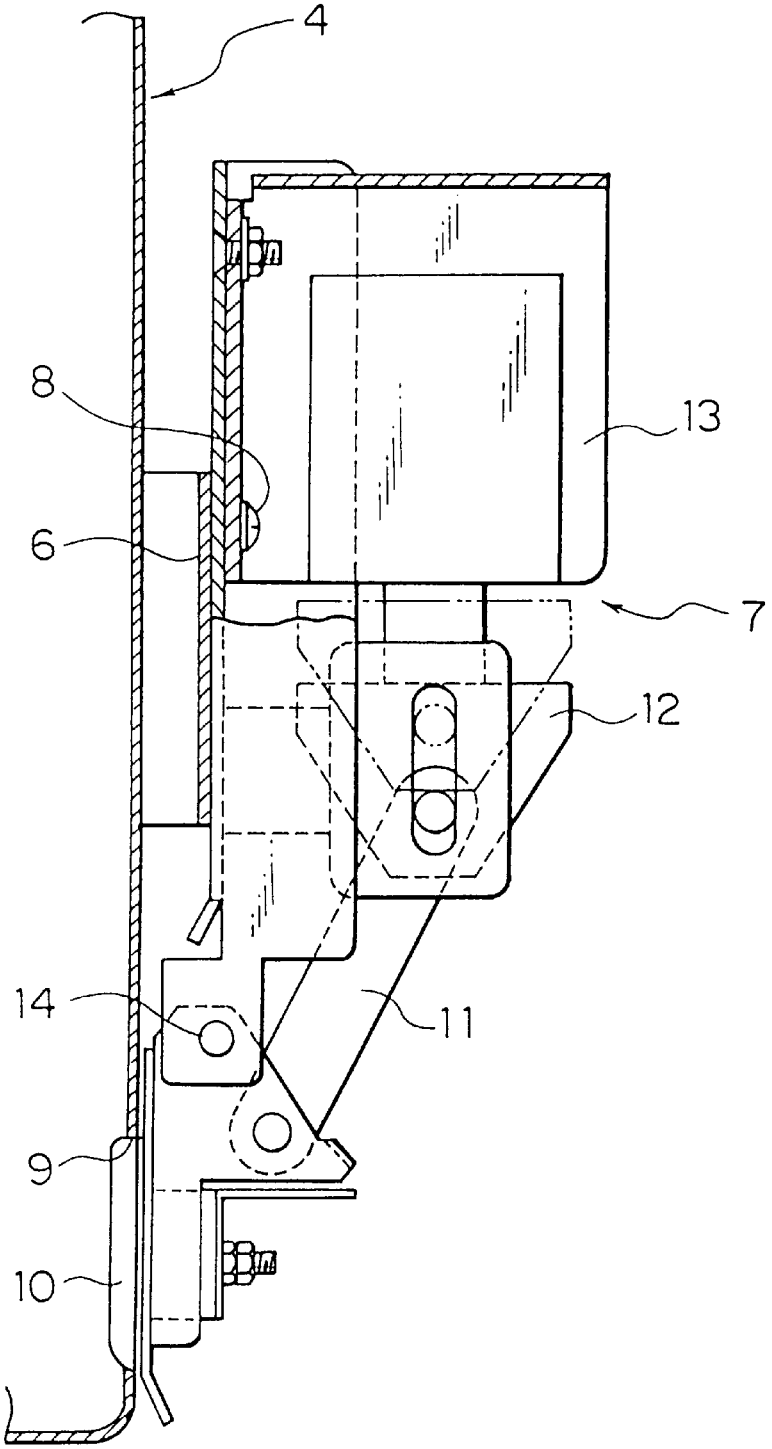
FIG. 6 PRIOR ART
FIG. 6 is a sectional view taken along the line VI—VI of FIG. 5.

FIG. 3 is a perspective view showing an ice stocker and a shutter mechanism of an ice dispenser in accordance with a second embodiment of the present invention. In this ice dispenser, a spacer part 41 is formed integrally with a thermally insulating layer 42. With such an arrangement that the spacer part 41 and the thermally insulating layer 42 are made integral, unlike the construction where the spacer and the thermally insulating layer are separated from each other, the spacer is free from being mispositioned when the shutter mechanism 24 is mounted to the bracket 23. The shutter mechanism 24 can be therefore mounted to the bracket 23 with ease. Further, the upper portion of the outer surface of the spacer part 41 is formed with a positioning portion 43 for defining the position of the shutter mechanism 24. The positioning portion 43 is arranged to project beyond the outer surface of the spacer part 41 is formed into a "U" shape to receive the profile of the shutter mechanism 24 so that it can determine the position of the shutter mechanism 24 in vertical and horizontal directions. Also, the positioning portion 43 is so arranged to allow the outer periphery of the shutter mechanism 24 to abut against the inside of the "U" shape thereof when screw insertion through-holes 33 formed in the shutter mechanism 24 and screw insertion through-holes 44 formed in the bracket 23 are arranged concentrically. If the shutter mechanism 24 abuts against the inside of the "U" shape of the positioning portion 43 in order to mount the shutter mechanism 24 to the bracket 23, the screw insertion through-holes 33 and the screw insertion through-holes 44 are aligned with each other. Therefore, the mounting of the shutter mechanism 24 is further facilitated.

Incidentally, although the ice dispenser in accordance with each embodiment described above includes an ice maker portion for making ice, the ice dispenser of the present invention is not limited to this arrangement. The present invention can be also applied to such an ice dispenser having no ice maker portion therein.

In the foregoing description, an ice dispenser according to the present invention is so arranged that a spacer made of a thermally insulating material is intervened between a shutter mechanism and a bracket. This will prevent the cold inside an ice stocker from being conducted into the shutter mechanism and also will prevent dew-condensation water from being deposited on the shutter mechanism. As a result, malfunction of the shutter mechanism resulting from dew-condensation water can be obviated.

Further, since a spacer is formed integrally with a thermally insulating material covering the outer surface of an ice stocker, the spacer will not be mispositioned with respect to a bracket so that the mounting of the shutter mechanism can be facilitated. Furthermore, since the spacer is formed with a positioning portion, the shutter mechanism can be more easily positioned when the shutter mechanism is attached.

What is claimed is:

1. An ice dispenser comprising:

an ice stocker formed of metal and having an ice discharge opening;

a bracket formed of metal and mounted on an outer wall surface of said ice stocker;

a thermally insulating layer covering said outer wall surface of said ice stocker;

a spacer formed of thermally insulating material and being integral with said thermally insulating layer; and a shutter mechanism for opening/closing said ice discharge opening, said shutter mechanism being mounted to said bracket with said spacer there between.

2. An ice dispenser as claimed in claim 1, wherein said shutter mechanism and said spacer are secured to said bracket by common screws.

3. An ice dispenser as claimed in claim 1, wherein said spacer has a protrusion for positioning said shutter mechanism in a predetermined position.

* * * * *